US009899144B2

(12) United States Patent
Yang

(10) Patent No.: US 9,899,144 B2
(45) Date of Patent: Feb. 20, 2018

(54) RESONANT HIGH CURRENT DENSITY TRANSFORMER

(71) Applicant: YUJING TECHNOLOGY CO., LTD., New Taipei (TW)

(72) Inventor: Sen-Tai Yang, New Taipei (TW)

( * ) Notice: Subject to any disclaimer, the term of this patent is extended or adjusted under 35 U.S.C. 154(b) by 32 days.

(21) Appl. No.: 15/069,985

(22) Filed: Mar. 15, 2016

(65) Prior Publication Data

US 2017/0110241 A1 Apr. 20, 2017

(30) Foreign Application Priority Data

Oct. 14, 2015 (TW) ..... 104133675 A

(51) Int. Cl.

| | |
|---|---|
| ***H01F 27/28*** | (2006.01) |
| ***H01F 27/24*** | (2006.01) |
| ***H01F 27/34*** | (2006.01) |
| ***H01F 27/32*** | (2006.01) |

(52) U.S. Cl.

CPC ..... *H01F 27/346* (2013.01); *H01F 27/24* (2013.01); *H01F 27/28* (2013.01); *H01F 27/325* (2013.01)

(58) Field of Classification Search

CPC ..... H01F 27/346; H01F 27/325

See application file for complete search history.

(56) References Cited

U.S. PATENT DOCUMENTS 4,510,478 A * 4/1985 Finkbeiner ..... H01F 27/306 336/198
4,716,394 A * 12/1987 Gordon ..... H01F 27/306 242/118.41
5,155,457 A * 10/1992 Oda ..... H03H 1/0007 333/167
7,365,630 B1 * 4/2008 Yang ..... H01F 3/12 336/198
7,498,921 B1 * 3/2009 Wang ..... H01F 27/2852 336/200
2009/0066459 A1 * 3/2009 Chih ..... H01F 27/306 336/198
2009/0309684 A1 * 12/2009 Tsai ..... H01F 27/2866 336/105

(Continued)

*Primary Examiner* — Elvin G Enad
*Assistant Examiner* — Malcolm Barnes
(74) *Attorney, Agent, or Firm* — Prakash Nama; Global IP Services, PLLC

(57) ABSTRACT

A resonant high current density transformer including two cores that are abut against each other with their first and second side posts on two sides thereof. A first bobbin envelops the first side posts on the same side of the two cores. A side plate is provided on either end of the first bobbin. The space between the two side plates is divided into two coil slots with a spacer, and at least a wire is wound in each coil slot to form a primary winding. A further second bobbin envelops the second side posts on the same side of the two cores. The outer periphery of the second bobbin is divided into two winding regions by another spacer, and a metal plate envelops each of the winding regions to form a secondary winding. A bobbin mount is disposed at the external flank of the second bobbin with a barrier plate at a side thereof for separating the first and the second bobbins. An insulating separating cover is provided on a side of the first bobbin closer to the bobbin mount, and the two ends of the separating cover cover the top and bottom sides of the first bobbin, respectively.

7 Claims, 3 Drawing Sheets

(56) References Cited

U.S. PATENT DOCUMENTS

| | | | | |
|---|---|---|---|---|
| 2010/0033284 | A1* | 2/2010 | Yamakami | H01F 27/324 336/192 |
| 2011/0006869 | A1* | 1/2011 | Huh | H01F 38/10 336/221 |
| 2011/0221559 | A1* | 9/2011 | Tsai | H01F 27/325 336/192 |
| 2012/0081204 | A1* | 4/2012 | Garrity | H01F 27/2847 336/221 |
| 2012/0182113 | A1* | 7/2012 | Pan | H01F 27/325 336/196 |
| 2012/0223797 | A1* | 9/2012 | Won | H01F 27/306 336/170 |
| 2012/0223799 | A1* | 9/2012 | Hester | H01F 27/30 336/220 |
| 2014/0184378 | A1* | 7/2014 | Wild | H01F 27/325 336/207 |
| 2014/0266528 | A1* | 9/2014 | Yang | H01F 27/24 336/83 |
| 2014/0266559 | A1* | 9/2014 | Yang | H01F 27/263 336/233 |

* cited by examiner

RESONANT HIGH CURRENT DENSITY TRANSFORMER

CROSS REFERENCE TO RELATED APPLICATIONS

This non-provisional application claims priority under 35 U.S.C. § 119(a) on Patent Application No. 104133675, filed in Taiwan, Republic of China on Oct. 14, 2015, the entire contents of which are hereby incorporated by reference.

BACKGROUND OF THE INVENTION

Field of the Invention

The invention relates to a resonant high current density transformer, and more particularly, to a reduced-sized resonant transformer capable of increasing power density and easy of automated processing.

Description of the Related Art

In power supply system for electronic products such as LCD TVs, a main type of transformers used is transformers with leakage inductance property (such as LLC transformer) that reduces switching loss and noise.

In TW Utility Patent Publication No. M333646 titled "Improvement of Leakage-Inductance-type Resonant Transformer", the transformer mainly includes: an outer bobbin provided with a first through-hole and a first recessed hole; an inner bobbin fitted inside the first through-hole of the outer bobbin, the inner bobbin being provided with a second through-hole and a second recessed hole; a core assembly with a first core, a second core and a third core, wherein the first and second cores are disposed in the second through-hole of the inner bobbin and the third core is disposed in the first recessed hole of the outer bobbin and the second recessed hole of the inner bobbin. By fitting the inner bobbin into the first through-hole of the outer bobbin, the coils in a first winding region and the coils in a second winding region can be overlapped to increase coupling. In addition, since the outer bobbin is provided with the recessed hole, heat generated from the coils of the inner bobbin can be effectively dissipated. Further, by providing the third core in the recessed holes, magnetic lines are able to form a sub-loop that increases the leakage inductance.

In addition, in TW Patent Publication No. I416553 titled "LLC Transformer Structure", the transformer includes: a first winding base including: a body with a first winding region and a plurality of single-slot second winding regions, the first winding region having a plurality of guide pins, and the plurality of single-slot second winding regions being disposed at either side of the first winding region, the body having a first sidewall and a second sidewall on two opposite sides, and each of the first and second sidewalls having an opening; and a first channel running through the body; a primary winding wound on the first winding region of the first winding base and connected to the plurality of guide pins; a plurality of secondary winding wound on the plurality of single-slot second winding regions of the first winding base; a cover having a second channel, the second channel being in communication with the openings of the first and second sidewalls when the cover and the first winding base are being assembled together; and a magnetic core assembly partly provided in the first channel of the first winding base and the second channel of the cover.

By providing a plurality of single-slot second winding regions for winding a plurality of secondary windings separately, the windings and magnetic paths can be modified, and the size of the transformer can be reduced. In addition, the problem with a lack of control of the leakage inductance in the conventional transformer due to an air gap formed between the primary and secondary windings during the assembly of the magnetic core assembly can be eliminated.

However, the above two transformer designs still present the following shortcomings:

1. Conventional LLC transformer are usually formed by winding traditional wires (enameled wires) on the primary and secondary sides, but in the case of high current output, multi-strand secondary winding structure are often used to achieve a higher current tolerance. However, with these winding structures with multi-strand wires (enameled wires), it can be difficult to strip off the insulation layers, there might also be difficulties in output wiring or wire twisting due to the large number of strands. Furthermore, gaps are created between wires (enameled wires), so the size of the transformer cannot be reduced.

2. In conventional LLC transformer structures, the primary and secondary windings are wound on different locations of a single bobbin (winding base), in addition to winding, interspersing insulation sleeves and twisting wires are labor intensive.

3. In conventional LLC transformer structures, there is an approach of using metal plates to replace the secondary winding. However, if the primary and secondary windings are provided on the same bobbin, distances associated with safety regulations may not be long enough, and leakage inductance cannot be easily modified, so an additional inductor is needed as a resonant inductor. On the other hand, if the primary and secondary windings are provided on the two bobbins, a constant distance between the two bobbins is difficult to maintain, which results in drifts in characteristics such as the leakage inductance.

In view of the shortcomings in the conventional transformer structures, the present invention is proposed to provide improvements that address these shortcomings.

SUMMARY OF THE INVENTION

One main objective of the present invention is to provide a resonant high current density transformer that uses metal plates in place of traditional wires (enameled wires) as the secondary winding to increase the effective conductive cross-sectional area in a unit area, thereby effectively reducing the size of the transformer.

Another objective of the present invention is to provide a resonant high current density transformer that allows the primary and secondary windings to be disposed on two separate bobbins, and the two bobbins fit onto the side posts on two sides of two cores. This enables easy assembly of each winding, increases processing efficiency, and also reduces the size of the transformer, thus realizing the characteristic of high power density.

Yet another objective of the present invention is to provide a resonant high current density transformer that allows the primary and secondary windings to be disposed on two separate bobbins. The two bobbins are fastened to each other by mechanical structures such as corresponding engaging slots and tenons. This effectively regulates the distance between the two bobbins, and controls the characteristics of the transformer such as the leakage inductance.

In order to achieve the above objectives and efficacies, the technical means employed by the present invention may include: two cores, each including first and second side posts extending in the same direction from two sides thereof, wherein the two cores abut against each other with the two first side posts facing each other and the two second side posts facing each other; a first bobbin provided with a penetrating first through-hole that envelops the first side posts on the same side of the two cores, wherein a side plate is provided on the outer periphery of either end of the first through-hole, and a spacer is provided on the first bobbin between the two side plates on the outer periphery of the first through-hole, and two coil slots are formed on the two sides of the spacer, respectively; a primary winding formed by winding wires around the two coil slots of the first bobbin; a second bobbin provided with a penetrating second through-hole that envelops the second side posts on the same side of the two cores, wherein the second bobbin is provided with a spacer on the mid-section of the outer periphery of the second through-hole, and two winding regions and are formed on the two sides of the spacer, respectively; two metal plates bent to envelop the outer peripheries of the winding regions and of the second bobbin to form a secondary winding; a bobbin mount disposed at the external flank of the second bobbin, the bobbin mount including a base provided with a barrier plate on a side closer to the first bobbin, wherein the barrier plate is used for separating the first and second bobbins; and an insulating "U-shape" separating cover provided on a side of the first bobbin closer to the bobbin mount, wherein the two ends of the separating cover cover the top and bottom sides of the first bobbin, respectively.

Based on the above structure, a lateral fastening groove is provided on a side of each side plate closer to the coil slot, whereas a lateral flap corresponding to each lateral fastening groove is provided on each of two lateral edges of the separating cover, and the separating cover is secured at the outer side of the coil slots of the first bobbin by inserting each lateral flap into the corresponding lateral fastening groove.

Based on the above structure, a first engaging tenon and a first engaging slot are provided on a side of the first bobbin closer to the bobbin mount, whereas a corresponding second engaging slot and a corresponding second engaging tenon are provided on a side of the bobbin mount closer to the first bobbin, and the bobbin mount and the first bobbin are joined together by inserting the first engaging tenon into the second engaging slot, and the second engaging tenon into the first engaging slot.

Based on the above structure, the first bobbin is provided with a first side retainer on each of the two side plates, and a first positioning recess is provided on a side of each first side retainer facing the first through-hole, whereas the base is provided with a second side retainer at each of the two ends thereof on a side away from the barrier plate, and a second positioning recess is provided on a side of each second side retainer facing the barrier plate, and the first and the second positioning recesses abut against two lateral edges of the two cores, respectively.

Based on the above structure, a plurality of terminals are provided on the first and the second side retainers.

Based on the above structure, the base is provided with a middle slot between the barrier plate and the second side retainers, and a side slot is provided on each of the two sides of the middle slot, whereas each of the metal plates include a lateral end and a middle end, and the middle ends of the metal plates both pass through the middle slot, while the lateral ends of the metal plates at different winding regions pass through different lateral slots.

Based on the above structure, a plurality of gaps are provided on the spacer of the first bobbin.

The objectives, efficacies and features of the present invention can be more fully understood by referring to the drawing as follows:

DETAILED DESCRIPTION OF THE INVENTION

Figure 1:
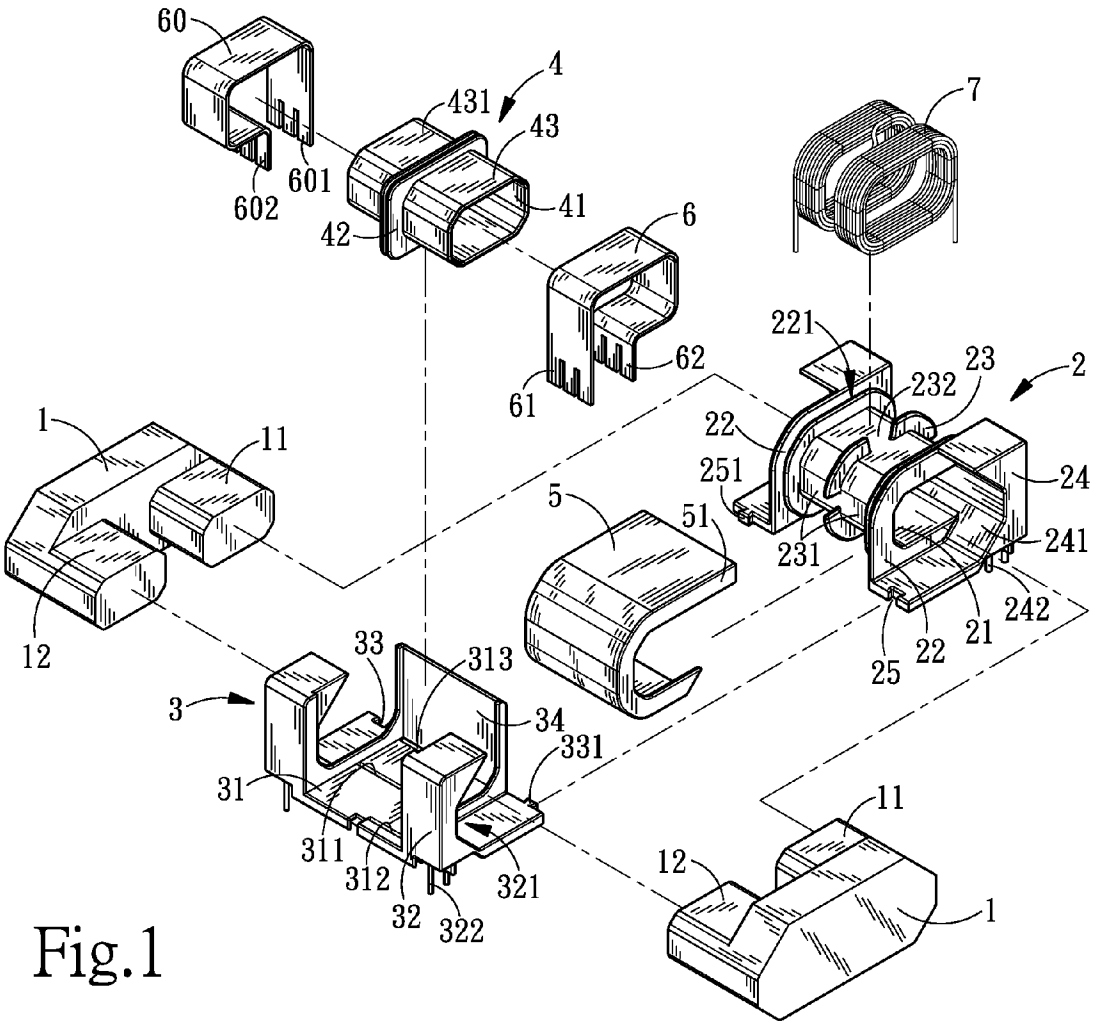
FIG. 1 is an exploded view of the structure of the present invention.
Figure 2:
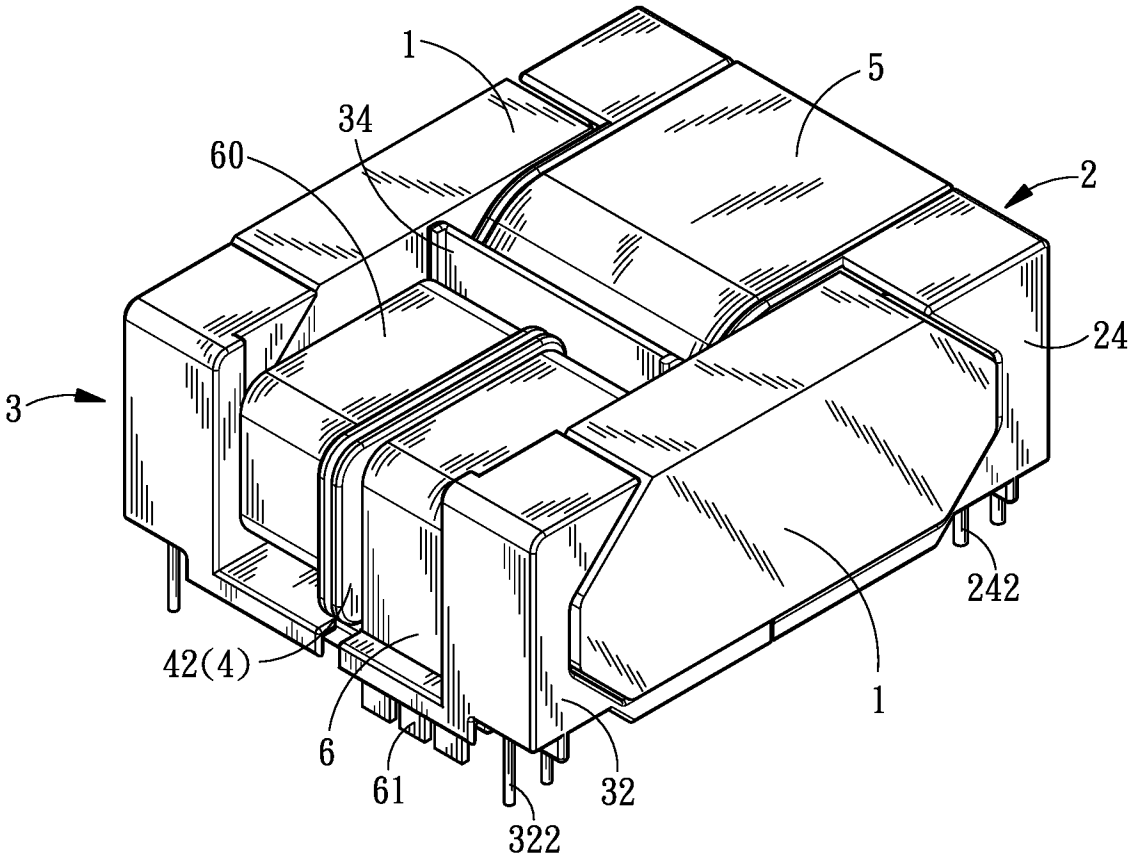
FIG. 2 is an exterior view of the overall assembly of the present invention.
Figure 3:
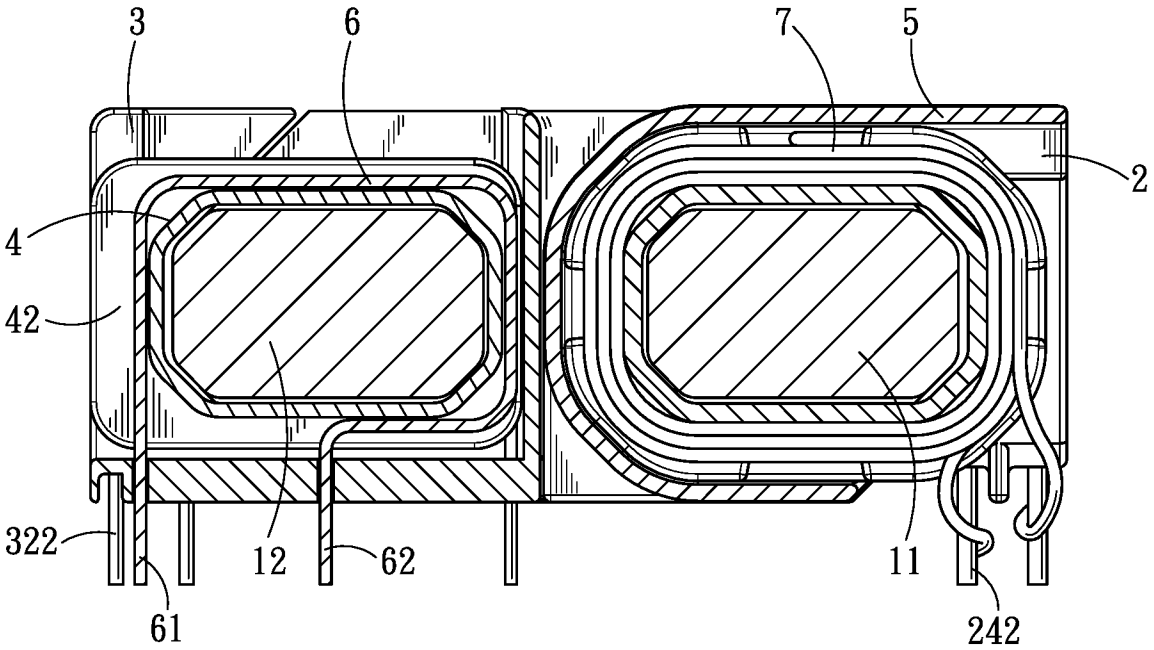
FIG. 3 is a cross-sectional view of the assembly of the present invention.

Referring to FIGS. 1 to 3, it can be understood that the structure of the present invention mainly includes: two cores 1, a first bobbin 2, a bobbin mount 3, a second bobbin 4, a separating cover 5, a metal plate 6 and a primary winding 7; wherein first and second side posts 11 and 12 extending in the same direction from the two sides of each of the cores 1. When the two cores 2 abut against each other with the two first side posts 11 facing each other and the two second side posts 12 facing each other, a magnetic loop is formed.

The first bobbin 2 is provided with a penetrating first through-hole 21, which envelops the first side posts 11 on the same side of the two cores 1 at their outer peripheries. A side plate 22 is provided on the outer periphery of either end of the first through-hole 21. A spacer 23 is provided between the two side plates 22. Two coil slots 231 are formed on the two sides of the spacer 23, respectively. A plurality of gaps 232 are provided on the spacer 23. A lateral fastening groove 221 is provided on the side of each side plate 22 closer to the coil slot 231, whereas a first side retainer 24 is provided on the side of each side plate 22 away from the coil slot 231. A first engaging tenon 251 (e.g. a dovetail tenon) and a first engaging slot 25 (e.g. a dovetail slot) are provided on a side of the first bobbin 2 away from the first side retainers 24. A plurality of terminals 242 are provided on the two first side retainers 24. A first positioning recess 241 is provided on the side of each first side retainer 24 facing the first through-hole 21; in one possible embodiment, the first positioning recess 241 has an edge shape conforming to the side of the core 1 closer to the first side post 11, such that the first positioning recess 241 conforms to and abuts against the side edge of the core 1 closer to the first side post 11 to facilitate positioning.

The primary winding 7 is formed by winding wires around each coil slot 231 of the first bobbin 2, and the gaps 232 allow wires to pass through. The wire ends of the primary winding 7 are connected to the terminals 242.

The second bobbin 4 is provided with a penetrating second through-hole 41, which envelops the second side posts 12 on the same side of the two cores 1 at their outer peripheries. The second bobbin 4 is provided with a spacer 42 on the mid-section of the outer periphery of the second through-hole 41. Winding regions 43 and 431 are formed on the two sides of the spacer 42, respectively.

The bobbin mount 3 is disposed at the external flank of the second bobbin 4. The bobbin mount 3 includes a base 31. A barrier plate 34 is provided on a side of the base 31 closer to the first bobbin 2. The barrier plate 34 is used for separating the first and second bobbins 2 and 4. A second engaging slot 33 (e.g. a dovetail slot) and a second engaging tenon 331 (e.g. a dovetail tenon), corresponding to the first engaging tenon 251 and the first engaging slot 25, respectively, are provided on a side of the bobbin mount 3 closer to the first bobbin 2. By inserting the first engaging tenon 251 into the second engaging slot 33, and the second engaging tenon 331 into the first engaging slot 25, the bobbin mount 3 and the first bobbin 2 can be joined together.

A second side retainer 32 is provided on both ends of the side of the base 31 away from the barrier plate 34. A plurality of terminals 322 are provided on each second side retainer 32. The base 31 is provided with a middle slot 311 between the barrier plate 34 and the second side retainers 32. A side slot 312 and a side slot 313 are provided on the two sides of the middle slot 311. A second positioning recess 321 is provided on the side of each second side retainer 32 facing the barrier plate 34. In one possible embodiment, the second positioning recess 321 has an edge shape conforming to the side of the core 1 closer to the second side post 12, such that the second positioning recess 321 conforms to and abuts against the side edge of the core 1 closer to the second side post 12 to facilitate positioning.

Two metal plates 6 and 60 are bent to envelop the outer peripheries of the winding regions 43 and 431 of the second bobbin 4, thereby forming a secondary winding. The metal plates 6 and 60 include lateral ends 61 and 601, respectively, and middle ends 62 and 602, respectively. The two metal plates 6 and 60 envelop the outer peripheries of the winding regions 43 and 431 of the second bobbin 4 in the opposite directions, such that the middle ends 62 and 602 of the metal plates 6 and 60 both pass through the middle slot 311; the lateral end 61 of the metal plate 6 passes through the lateral slot 312; and the lateral end 601 of the metal plate 60 passes through the lateral slot 313.

In one possible embodiment, the lateral ends 61 and 601 extend downwards from lateral edges of the metal plates 6 and 60, respectively, while the middle ends 62 and 602 bend and extend at the bottom middle portions of the metal plates 6 and 60. As a result, the distances between the middle ends 62 and 602 (the middle slots 311) and the two lateral ends 61 and 601 (the two lateral slots 312) can be reduced.

The separating cover 5 is a "U-shape" insulating plate provided on the side of the first bobbin 2 closer to the bobbin mount 3. The two ends of the separating cover 5 cover the top and bottom sides of the first bobbin 2. A lateral flap 51 corresponding to each lateral fastening groove 221 is provided on each lateral edge of the separating cover 5. By inserting each lateral flap 51 into the corresponding lateral fastening groove 221, the separating cover 5 can be secured at the outer side of the coil slots 231 of the first bobbin 2.

With the above structure and design, the present invention achieves at least the following technical effects:

1. Using the metal plates 6 and 60 in place of ordinary wires as the secondary winding, the overall current output capability is raised, and the size of the secondary winding (transformer) is effectively reduced.

2. By fitting the metal plates 6 and 60 onto the two winding regions 43 and 431 of the second bobbin 4, assembly is easier than the traditional coil winding method, and processing efficiency is greatly increased.

3. By disposing the primary winding 7 and the metal plates 6 and 60 (secondary winding) on the first and second bobbins 2 and 4, respectively, manufacturing of them can be performed in parallel simultaneously, and then the two are fastened together using corresponding engaging slots and tenons, and further assembled with other parts to form a complete transformer structure. This increases production speed and efficiency, while maintaining stable electrical characteristics of the transformer.

4. With the separating cover fencing off the primary and secondary, as well as the primary and the cores, the insulation strength and the creepage distance are increased, thus satisfying the more strict safety requirements specified in medical fields and the like.

In view of this, the resonant high current density transformer of present invention reduces the size of the transformer, increases power density and simplifies assembly process, and is thus submitted to be novel and non-obvious and a patent application is hereby filed in accordance with the patent law. It should be noted that the descriptions given above are merely descriptions of preferred embodiments of the present invention, various changes, modifications, variations or equivalents can be made to the invention without departing from the scope or spirit of the invention. It is intended that all such changes, modifications and variations fall within the scope of the following appended claims and their equivalents.

What is claimed is:

1. A resonant high current density transformer comprising:

two cores, each including first and second side posts extending in the same direction from two sides thereof, wherein the two cores abut against each other with the two first side posts facing each other and the two second side posts facing each other;

a first bobbin provided with a penetrating first through-hole that envelops the first side posts on the same side of the two cores, wherein a side plate is provided on the outer periphery of either end of the first through-hole, and a spacer is provided on the first bobbin between the two side plates on the outer periphery of the first through-hole, and two coil slots are formed on the two sides of the spacer, respectively;

a primary winding formed by winding wires around the two coil slots of the first bobbin;

a second bobbin provided with a penetrating second through-hole that envelops the second side posts on the same side of the two cores, wherein the second bobbin is provided with a spacer on the mid-section of the outer periphery of the second through-hole, and two winding regions and are formed on the two sides of the spacer, respectively;

two metal plates bent to envelop the outer peripheries of the winding regions and of the second bobbin to form a secondary winding;

a bobbin mount disposed at the external flank of the second bobbin, the bobbin mount including a base provided with a barrier plate on a side closer to the first bobbin, wherein the barrier plate is used for separating the first and second bobbins; and an insulating "U-shape" separating cover provided on a side of the first bobbin closer to the bobbin mount, wherein the two ends of the separating cover the top and bottom sides of the first bobbin, respectively.

2. The resonant high current density transformer of claim 1, wherein a lateral fastening groove is provided on a side of each side plate closer to the coil slot, whereas a lateral flap corresponding to each lateral fastening groove is provided on each of two lateral edges of the separating cover, and the separating cover is secured at the outer side of the coil slots of the first bobbin by inserting each lateral flap into the corresponding lateral fastening groove.

3. The resonant high current density transformer of claim 1, wherein a first engaging tenon and a first engaging slot are provided on a side of the first bobbin closer to the bobbin mount, whereas a corresponding second engaging slot and a corresponding second engaging tenon are provided on a side of the bobbin mount closer to the first bobbin, the bobbin mount and the first bobbin are joined together by inserting the first engaging tenon into the second engaging slot and the second engaging tenon into the first engaging slot.

4. The resonant high current density transformer of claim 1, wherein the first bobbin is provided with a first side retainer on each of the two side plates, and a first positioning recess is provided on a side of each first side retainer facing the first through-hole, whereas the base is provided with a second side retainer at each of the two ends thereof on a side away from the barrier plate, and a second positioning recess is provided on a side of each second side retainer facing the barrier plate, and the first and the second positioning recesses abut against two lateral edges of the two cores, respectively.

5. The resonant high current density transformer of claim 4, wherein a plurality of terminals are provided on the first and the second side retainers.

6. The resonant high current density transformer of claim 4, wherein the base is provided with a middle slot between the barrier plate and the second side retainers, and a side slot is provided on each of the two sides of the middle slot, whereas each of the metal plates include a lateral end and a middle end, and the middle ends of the metal plates both pass through the middle slot, while the lateral ends of the metal plates at different winding regions pass through different lateral slots.

7. The resonant high current density transformer of claim 1, wherein a plurality of gaps are provided on the spacer of the first bobbin.

* * * * *